US006845520B2

(12) United States Patent
Kim

(10) Patent No.: US 6,845,520 B2
(45) Date of Patent: Jan. 25, 2005

(54) CAP

(76) Inventor: Jae-Wook Kim, 241, Gil-dong, Kangdong-ku, Seoul (KR)

( * ) Notice: Subject to any disclaimer, the term of this patent is extended or adjusted under 35 U.S.C. 154(b) by 48 days.

(21) Appl. No.: 10/356,764

(22) Filed: Jan. 30, 2003

(65) Prior Publication Data

US 2004/0045076 A1 Mar. 11, 2004

(30) Foreign Application Priority Data

Sep. 5, 2002 (KR) ..... 20-2002-0026615
Sep. 5, 2002 (KR) ..... 20-2002-0026614

(51) Int. Cl.[7] ..... A42B 1/00
(52) U.S. Cl. ..... 2/181; 2/195.1
(58) Field of Search ..... 2/171.1, 171, 175.1; D2/871, 875

(56) References Cited

U.S. PATENT DOCUMENTS 1,598,379 A * 8/1926 Kerr ..... 2/171.02
D103,853 S * 3/1937 Mariani ..... D2/871
4,131,953 A * 1/1979 Kimotsuki ..... 2/171.1
6,120,531 A * 9/2000 Zhou et al. ..... 607/111
6,389,603 B1 * 5/2002 Dorantes Perez ..... 2/171.03

* cited by examiner

*Primary Examiner*—Katherine Moran
(74) *Attorney, Agent, or Firm*—Blakely Sokoloff Taylor & Zafman

(57) ABSTRACT

The present invention discloses a cap. The cap is very useful in many aspects that it not only blocks the sun but also cools the head of the cap wearer, by tying the ends of the covers bands together or connecting them with a Velcro tape, thereby providing the cap wearer with more satisfaction of wearing the cap. In addition, the cap of the present invention is not easily slid off the head by wind or some motions of the cap wearer by applying the resin adsorption layer containing germanium, it being known to be not harmful to a human body and have an excellent adsorption capacity, to the entire inner surface or some parts of bands of the cap at regular intervals so as to stabilize brain waves of the cap wearer by taking advantage of ionization energy and far-infrared energy radiated from germanium, thereby releasing insomnia, stress and headache caused by unstable brain waves and improving concentration and memory.

2 Claims, 10 Drawing Sheets

CAP

BACKGROUND OF THE INVENTION

1. Field of the Invention

The present invention generally relates to a cap. More particularly, the present invention relates to a cap having several bands, which is effective for blocking the sun as well as ventilating (i.e. cooling) the head of a person wearing the cap by tying the ends of those bands together or sticking them with a Velcro tape. Also, the cap is not easily slid off the head by wind or some motions of the person thanks to a resin adsorption layer containing powder type germanium that is applied to the entire inner surface or some parts of bands of the cap at regular intervals, and ionization energy and far-infrared energy radiated from germanium are beneficial for stabilizing brain waves of the person (cap wearer), whereby the cap can contribute to releasing insomnia, stress and headache caused by unstable brain waves and improving concentration and memory.

2. Description of the Related Art

In general, a cap 10, as depicted in FIG. 1, consists of a brim 1 for blocking the sun, a circular-ring shaped band 2 connected to the brim 1, being in touch with the head, and a cover 3 for completely covering the head, it being pulled over the band 2.

However, this kind of cap 10 is sometimes very uncomfortable to wear especially for an extended period of time since the cover 2 of the cap 10 completely covers the head, being unable to cool the head of a cap wearer.

As an attempt to solve the above problem, some developed a brim cap 20 simply for blocking the sun. As shown in FIG. 2, the brim cap 20 for blocking the sun consists of the brim 1 and the band 2 only. Reference numerals are unified here to skip the same description on the same parts.

The problem with the brim cap 20 was though it could not provide an excellent feeling of wearing. Rather, it made people wearing it uneasy.

More specifically, unlike the conventional cap with the circular-ring shaped band, the band 2 of the brim cap 20 was extended from both ends of the brim 1.

As such, in case the elastic force of the band necessary for compressing the head is weakened, the brim cap 20 was easily slid off the head even when the cap wearer did not want it to happen at all.

SUMMARY OF THE INVENTION

It is, therefore, an object of the present invention to provide a cap having several bands, which is effective for blocking the sun as well as ventilating (i.e. cooling) the head of a person wearing the cap by tying the ends of those bands together or sticking them with a Velcro tape, thereby providing cap wearers with more satisfaction of wearing the cap.

Another object of the present invention is to provide a cap, which is not easily slid off the head by wind or some motions of a cap wearer by applying a resin adsorption layer containing germanium, it being known to be not harmful to a human body and have an excellent adsorption capacity, to the entire inner surface or some parts of bands of the cap at regular intervals so as to stabilize brain waves of the cap wearer by taking advantage of ionization energy and far-infrared energy radiated from germanium, thereby releasing insomnia, stress and headache caused by unstable brain waves and improving concentration and memory.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

A preferred embodiment of the present invention will be described herein below with reference to the accompanying drawings. In the following description, well-known functions or constructions are not described in detail since they would obscure the invention in unnecessary detail.

Figure 1:
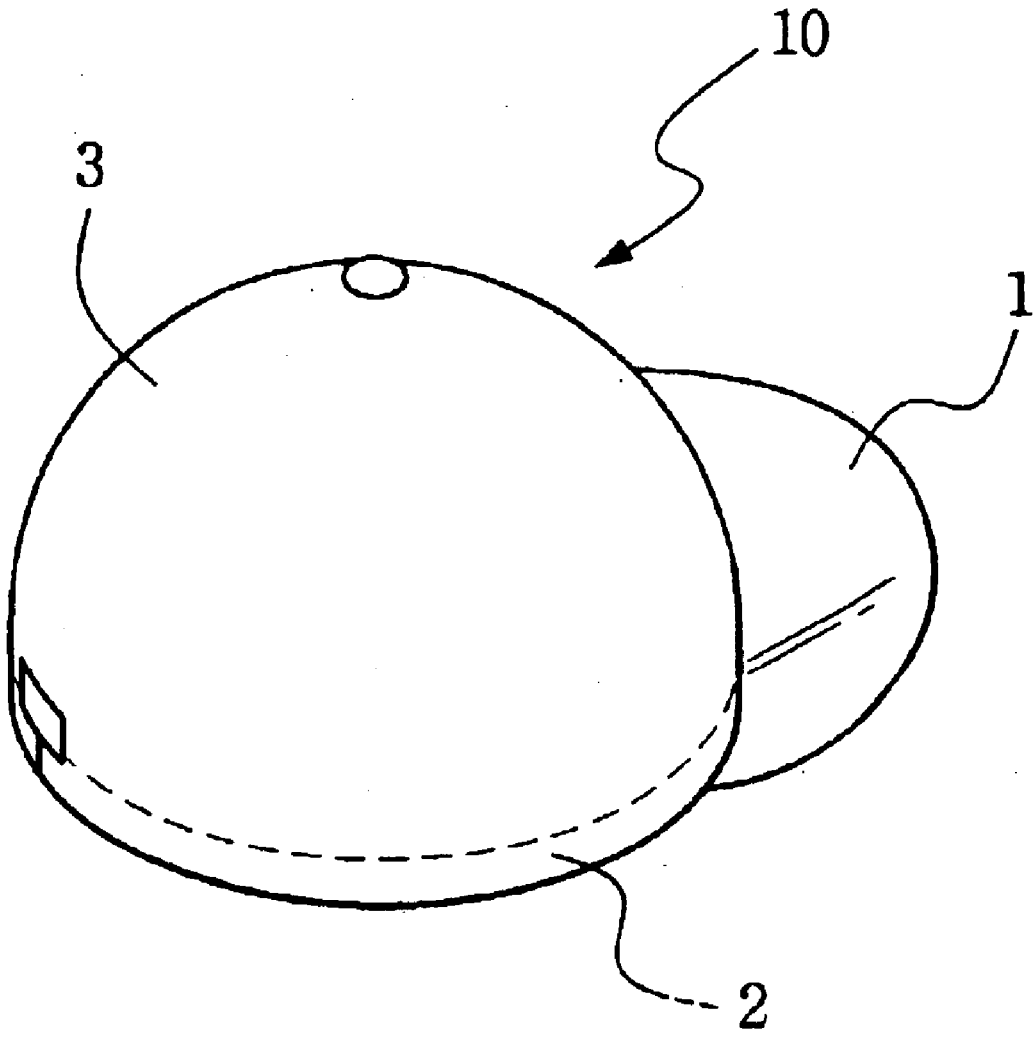
FIG. 1 is a schematic diagram of a known cap with a cover according to a related art.
Figure 2:
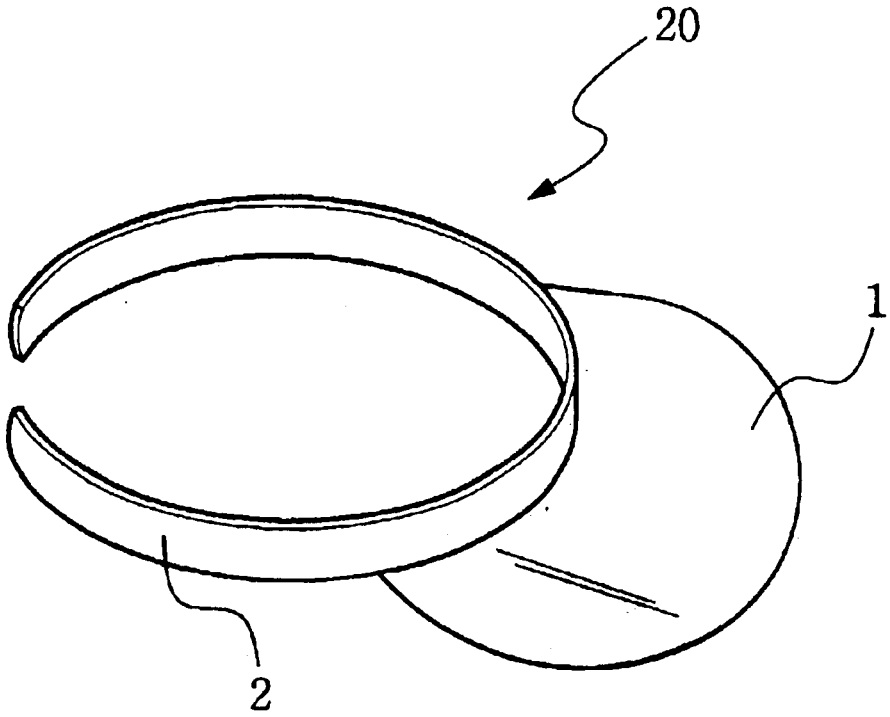
FIG. 2 is a schematic diagram of a known cap without a cover according to a related art.
Figure 3:
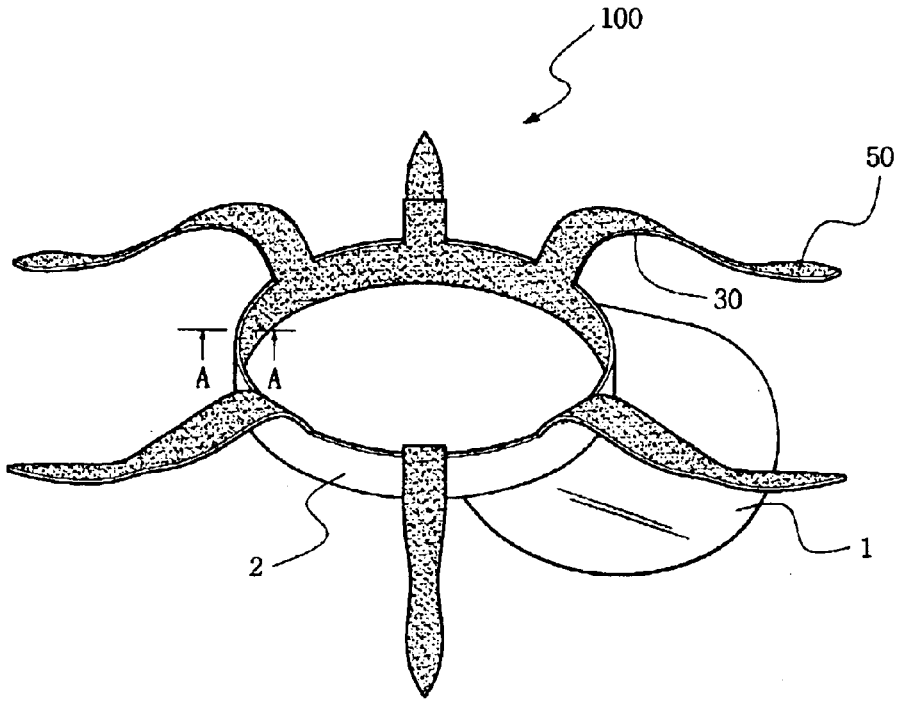
FIG. 3 is a perspective view of a cap according to the first embodiment of the present invention, in which cover bands of the cap are separated from each other.
Figure 4:
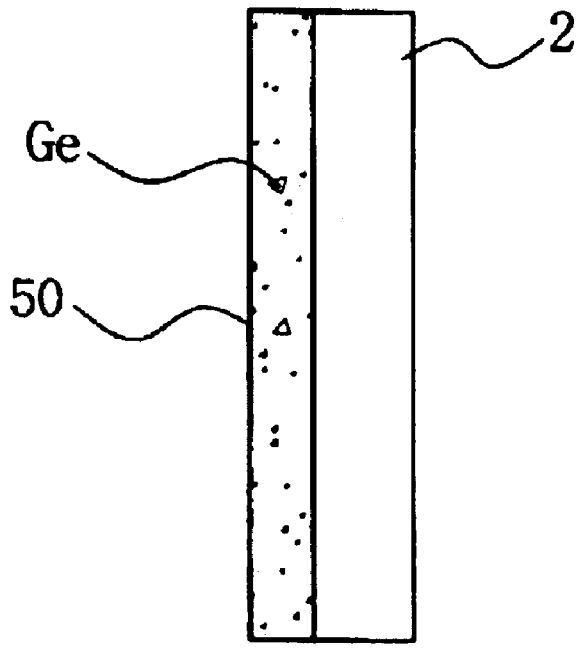
FIG. 4 is a cross-sectional view taken along line A—A of FIG. 3 according to the first embodiment of the present invention.

FIG. 3 is a perspective view of a cap according to a first embodiment of the present invention, in which cover bands of the cap are separated from each other; FIG. 4 is a cross-sectional view taken along line A—A of FIG. 3 according to the first embodiment of the present invention; and FIG. 5 is a schematic diagram illustrating the cover bands of the cap are tied or knotted together according to the first embodiment of the present invention.

Figure 5:
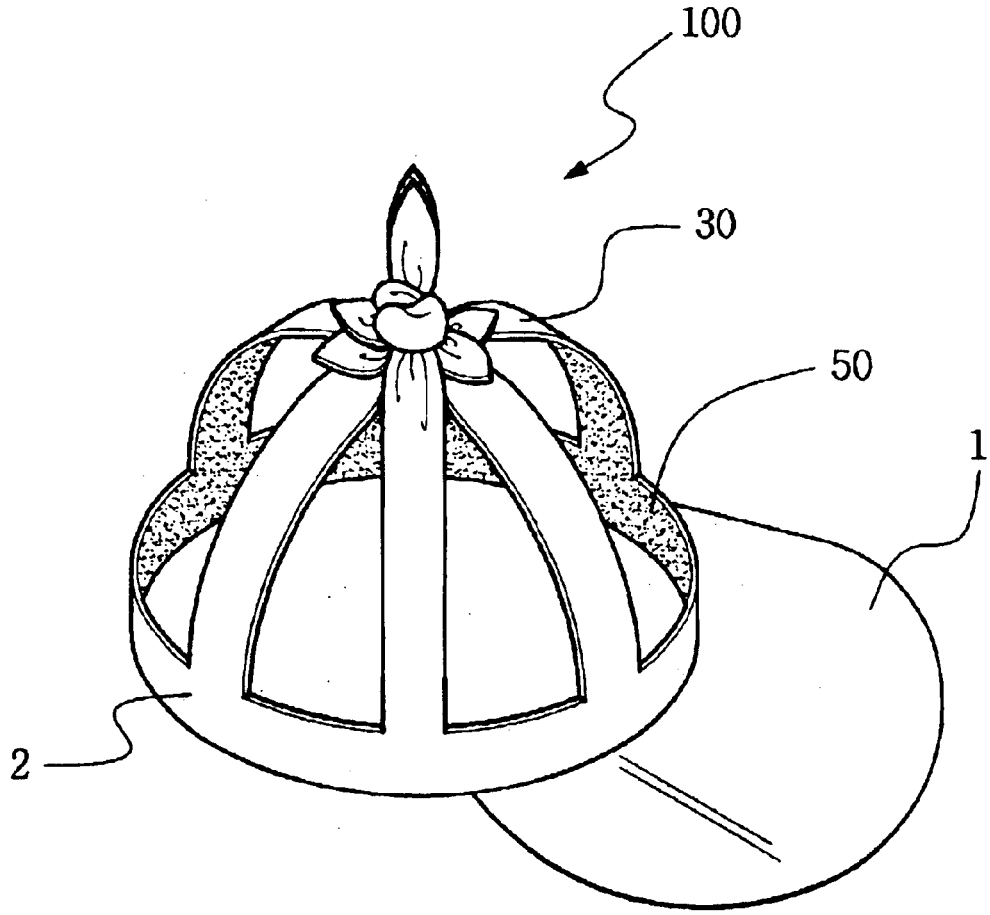
FIG. 5 is a schematic diagram illustrating the cover bands of the cap are tied (or knotted) according to the first embodiment of the present invention.

As depicted in FIGS. 3 through 5, the cap consists of a brim 1 for blocking the sun and a circular-ring shaped band 2.

Particularly, a plurality of cover bands 30 are extended to the band 2 of the cap 100 at regular intervals for covering and at the same time, cooling the head by knotting their ends together.

On the other hand, a resin adsorption layer 50 is applied to an inner surface of the band 2 and the cover band 30 to prevent the cap 100 from being slid off the head by a strong wind or some other motions of the cap wearer.

The resin adsorption layer 50 contains liquefied germanium (Ge).

Preferably, the resin adsorption layer 50 is made of adsorptive rubber, soft silicon, or urethane material, which is not harmful to a human body yet adhesive. However other kinds of materials can be also used as long as they do not harm the human body.

According to the first embodiment of the present invention, when the user (i.e. cap wearer) puts on the cap 100, the band 2 of the cap 100 is tightly fit (or clung) to around the head of the user.

This is possible because of a plurality of cover bands 30 extended to the band 2 at regular intervals. That is, the user can cover his/her head by pulling up the cover bands 30.

If the user knots each end of the cover bands 30, the cover bands 30 will look like a cap, covering the head of the user. In addition, now that the head of the user is exposed to the outside through the spaces formed between each cover band 30, the user can expect that his/her head will be ventilated (i.e. cooled) no matter how long the user may wear the cap 100.

As discussed before, the resin adsorption layer 50 containing germanium is applied to the inner surface of the band 2 and cover bands 30 of the cap 100.

Thanks to the resin adsorption layer 50, when the user puts on the cap 100, the band 2 and the cover bands 30 can remain closely adhered to the head of the head. This explains why the cap 100 is not easily slid off the head by a strong wind or some violent motions of the user.

On the top of that, germanium (Ge) mixed with the resin adsorption layer 50 radiates an ionization energy and far-infrared activation energy to the user wearing the wig cap 100, thereby stabilizing brain waves of the user and releasing insomnia, stress and headache from unstable brain waves and improving concentration and memory.

Figure 6:
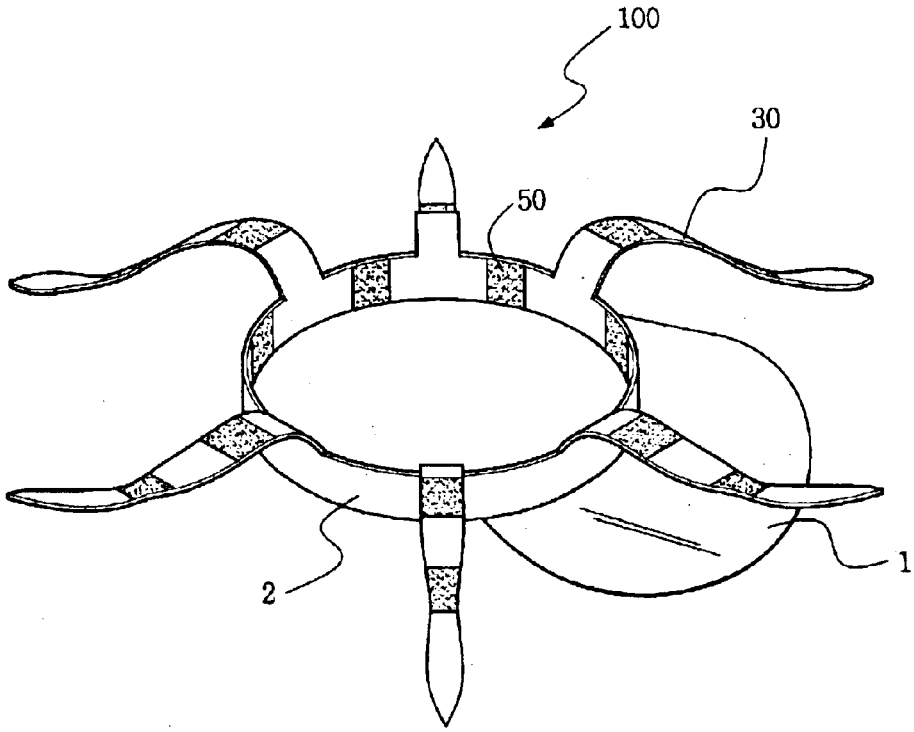
FIG. 6 is a perspective view of a resin adsorption layer formed at regular intervals according to the second embodiment of the present invention.

FIG. 6 is a perspective view of the resin adsorption layer 50 containing germanium formed at regular intervals on the inner surface of the band 2 and the cover bands 30 of the cap 100 according to another embodiment of the present invention. The reference numerals used in the first embodiment illustrated in FIGS. 3 through 5 are again used for the same parts in this embodiment, so the description on those parts will not be provided here.

The knot shape of the cover bands 30 can be diverse, depending on individual taste.

Figure 7:
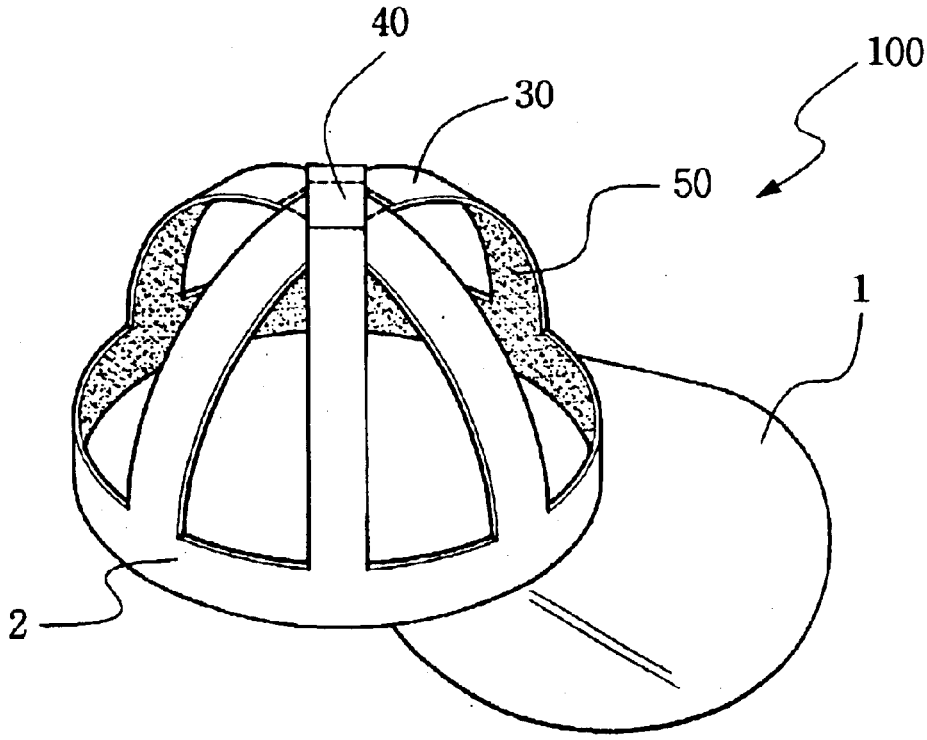
FIG. 7 is a schematic diagram of a cap according to the second embodiment of the present invention, in which cover bands of the cap are attached to each other by using a Velcro tape.

Although the ends of the cover bands 30 are knotted together in the first embodiment of the present invention, they could be tied together using a Velcro tape according to another embodiment shown in FIG. 7.

As depicted in the drawing, by placing the Velcro tape 40 with an adhesive property to each end of the cover bands 30, the cover bands 30 extended from the band 2 can be securely attached to each other.

Again, no further description on the parts with the unified reference numerals that are already illustrated in FIGS. 3 through 6 will be provided here.

Figure 8:
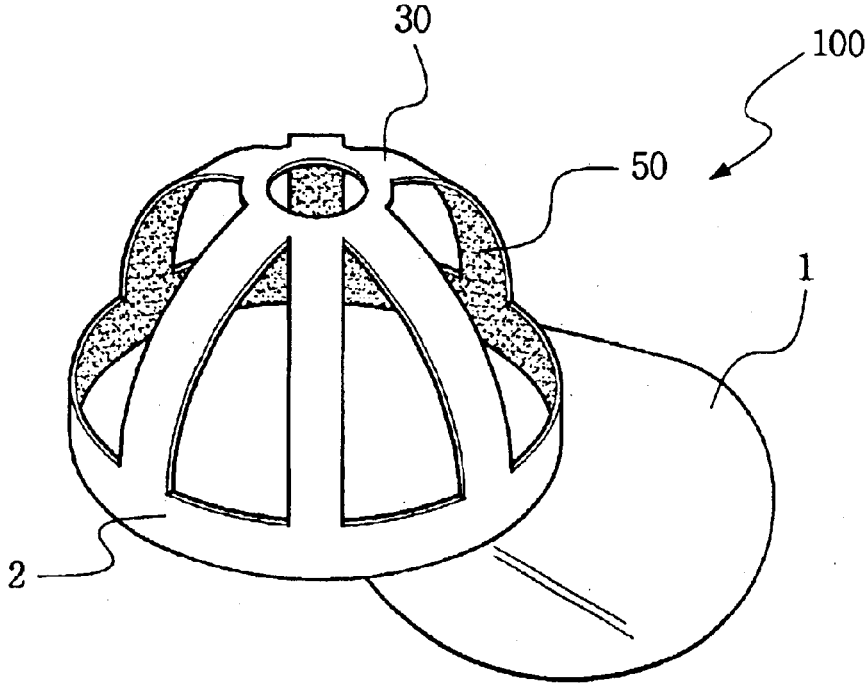
FIG. 8 is a schematic diagram of a cap according to the third embodiment of the present invention, in which a band and cover bands of the cap are attached together.
Figure 9:
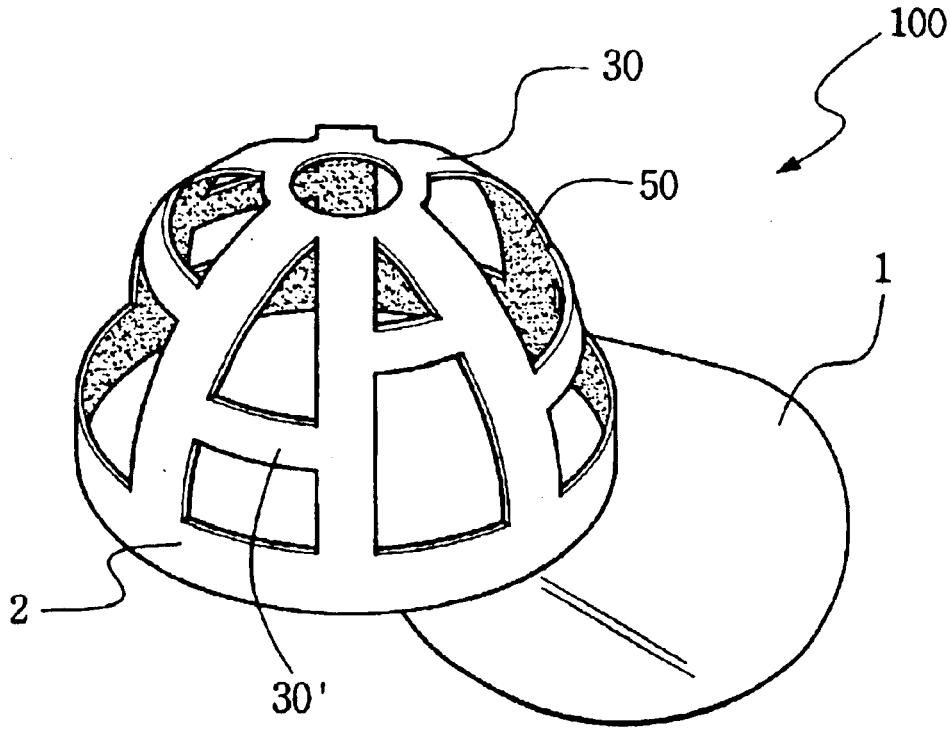
FIG. 9 is a schematic diagram of a cap according to the third embodiment of the present invention, in which a supplementary cover band is connected to cover bands of the cap.

Meanwhile, FIGS. 8 and 9 illustrate a cap according to yet another embodiment of the present invention. More specifically, FIG. 8 illustrates the cap 100 having a plurality of cover bands 30 attached to the band 2, and FIG. 9 illustrates the cap 100 having a plurality of cover bands 30 attached to the band 2 plus supplementary cover bands 30' attached between the cover bands 30, forming a cross (+) shape in the horizontal direction.

Similar to other caps discussed before, the cap 100 of the present embodiment also-employs the cover bands 30 to shield or cover the head of the user, allowing the head to be cooled through the spaces formed between the cover bands 30. Particularly, the supplementary cover bands 30' for connecting two neighboring cover bands 30 adds a creative sense of design to the cap 100 in addition to the function of cooling the head of the cap wearer.

In fact, the supplementary cover bands 30' can be diverse in its design and shape. Although FIGS. 8 and 9 illustrated only a single type of supplementary cover band 30' (i.e. transverse band formation), many other shapes and designs could be used for combining the cover bands 30. For some other people, the cover bands and the supplementary cover bands would not have to be combined at all.

Like before, no further description on the parts with the unified reference numerals that are already illustrated in FIGS. 3 through 7 will be provided here.

Figure 10:
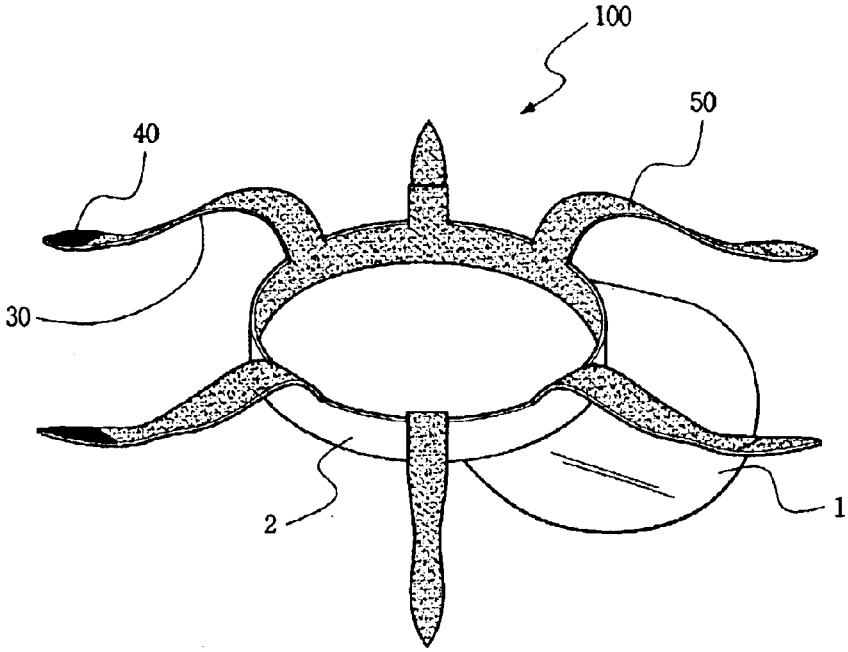
FIG. 10 is a schematic diagram of a cap according to the fourth embodiment of the present invention, in which a plurality of cover bands are knotted or bound together with a Velcro tape.

Lastly, FIG. 10 depicts a cap according to still another embodiment of the present invention. As shown in FIG. 10, the cover bands 30 could be knotted (e.g. tied) together or connected to each other by using the Velcro tape 40. Once again, reference numerals are unified with the previous embodiments, and further description on the same parts will not be provided here.

In conclusion, the cap of the present invention can be very advantageously used in many aspects that it not only blocks the sun but also cools the head of the cap wearer, by tying the ends of the covers bands together or connecting them with a Velcro tape, thereby providing the cap wearer with more satisfaction of wearing the cap. In addition, the cap of the present invention is not easily slid off the head by wind or some motions of the cap wearer by applying the resin adsorption layer containing germanium, it being known to be not harmful to a human body and have an excellent adsorption capacity, to the entire inner surface or some parts of bands of the cap at regular intervals so as to stabilize brain waves of the cap wearer by taking advantage of ionization energy and far-infrared energy radiated from germanium, thereby releasing insomnia, stress and headache caused by unstable brain waves and improving concentration and memory.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A cap comprising:

a brim coupled to a plurality of cover bands coupled with a fastener tape to the end of each cover band, said brim for blocking; and a circular-ring shaped band coupled to said brim, wherein the plurality of cover bands to be coupled to each other and extended from the circular-ring shaped band at regular intervals, and a resin adsorption layer mixed with germanium is formed to an inner surface of the circular-ring shaped band and plurality of cover bands.

2. The cap according to claim 1, further comprising:

a plurality of supplementary cover bands coupled between the plurality of cover bands, the supplementary cover bands having diverse shapes, wherein the plurality of supplementary cover bands for connecting the plurality of cover bands.

* * * * *